US006203646B1

(12) United States Patent
Gundberg et al.

(10) Patent No.: US 6,203,646 B1
(45) **Date of Patent: *Mar. 20, 2001**

(54) PROCESS FOR PREPARING A MINERAL FIBRE ELEMENT COMPRISING A SURFACE COATING

(75) Inventors: Martin Vendelbo Gundberg, Roskilde; Claus Bugge Garn, Kobenhaun, both of (DK)

(73) Assignee: Rockwool International A/S (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/895,837

(22) Filed: Jul. 17, 1997

Related U.S. Application Data

(63) Continuation of application No. 08/284,679, filed on Sep. 6, 1994, now abandoned.

(30) Foreign Application Priority Data

Feb. 28, 1992 (DK) ..... 267/92

(51) Int. Cl.[7] ..... B32B 19/06; B32B 5/26; B32B 31/30

(52) U.S. Cl. ..... 156/167; 156/177; 156/181; 156/244.15; 264/113; 264/115; 264/121; 427/180; 428/74

(58) Field of Search ..... 156/167, 62.4, 156/62.2, 244.15, 181, 177; 264/113, 115, 121, 112, 5, 12; 428/24; 427/180, 74

(56) References Cited

U.S. PATENT DOCUMENTS 3,808,040 * 4/1974 Baunes et al. ..... 156/177 X
3,972,759 * 8/1976 Buntin ..... 156/167
4,104,340 * 8/1978 Ward ..... 264/6
4,129,637 * 12/1978 Kennedy ..... 264/112 O
4,370,289 * 1/1983 Sorensen .
4,777,080 * 10/1988 Harris, Jr. et al. ..... 428/212
5,169,700 * 12/1992 Meier et al. ..... 428/74
5,219,633 * 6/1993 Sabee .
5,240,527 * 8/1993 Lostak et al. .
5,462,538 * 10/1995 Korpman .
5,501,872 * 3/1996 Allen et al. ..... 118/313 X

FOREIGN PATENT DOCUMENTS 2637725 3/1977 (DE) .
3922028 1/1991 (DE) .
0191744 8/1986 (EP) .
0420772 * 4/1991 (FR) .
2017578 10/1979 (GB) .
452440 11/1987 (SE) .

OTHER PUBLICATIONS

Dialog Information Servies, file 350, World Patent Index, Dialog accession No. 002223556, WPI Acc No: 79–22733B/12, (MATW) Matsushita Elec Works), "Heat insulating and waterproofing sheet laminate—e.g., comprising glass or rock wool mat and PVC, polyethylene, poly–propylene or asphalt; Polyvinyl Chloride", JP 54018882, A, 790213, 7912.

* cited by examiner

*Primary Examiner*—Sam Chuan Yao
(74) *Attorney, Agent, or Firm*—Ostrolenk, Faber, Gerb & Soffen, LLP

(57) ABSTRACT

A method of producing a mineral fibre element comprising a mineral fibre base layer having a surface coating in the form of a fibrous netting formed of a thermoplastic polymer material wherein such a surface coating is provided on at least a part of the surface of the base layer, wherein the surface coating is formed directly on the surface of the base layer and wherein the surface coating is formed by heating a thermoplastic polymer material so as to melt it and distributing the polymer melt obtained in the form of fibres and/or filaments on the surface of the base layer and cooling it to form a solid layer.

16 Claims, 3 Drawing Sheets

PROCESS FOR PREPARING A MINERAL FIBRE ELEMENT COMPRISING A SURFACE COATING

CROSS-REFERENCE TO RELATED APPLICATION

This application is a continuation of application Ser. No. 08/284,679, filed Sep. 6, 1994, now abandoned.

BACKGROUND OF THE INVENTION

The present invention relates to a method of producing a mineral fibre element comprising a mineral fibre base layer having a surface coating in the form of a fibrous netting formed of a thermoplastic polymer material, wherein such a surface coating is provided on at east a part of the surface of the base layer.

Mineral fibre material is used, among other things, for thermal and acoustic insulation in a n umber of connections.

In order to increase the tactility of the mineral fibre material used during the handling and mounting thereof it may be coated with a surface layer, e.g. consisting of a non-woven sheet material of polymer fibres.

Furthermore, such a surface coating serves to reduce or eliminate the release of fibre wads or single fibres from the mineral fibre material to the surroundings before, during or after mounting.

Furthermore, a surface coating of the above-mentioned type imparts a considerably increased tensile strength to the mineral fibre element.

It is known to produce mineral fibre elements of the type mentioned in the introductory part by adhering a pre-manufactured, non-woven web material consisting of polymer fibres to the surface of a web-formed mineral fibre material by using a resin, such as phenol formaldehyde resin, as an adhesive, and by subsequently cutting the coated mineral fibre web so as to form individual mineral fibre matts.

Non-woven polymer fibre materials can be produced from thermoplastic polymers which, among things, are characteristic in being adhesive in melted state. In the production of non-woven fibre materials the adhesive effect can be used to bond the individual fibres together to form a coherent layer.

However, the prior art method suffers from several drawbacks.

In order to impart sufficient strength to the non-woven material so as to enable it to resist strains during the handling thereof and in particular during the application of the material onto the uneven surface of the mineral fibre material, the material used should have a surface weight of at least about 20 g/m$^2$.

However, it is not necessary to use a surface coating having a surface weight of such a magnitude in order to obtain a functional coating, and hence the prior art method involves a certain waste of material.

Furthermore, the resin used for adhering the non-woven material implies an increase in the thermal value of the surface coated mineral fibre element, which is undesirable for fire safety reasons.

In addition, mineral fibre elements produced by the prior art method are relatively costly, which is partly due to the fact that non-woven polymer fibre materials are costly and partly that the method comprises at least two relatively difficult technical process steps, viz. 1) an even application of the adhesive onto the surface of the base layer and 2) mounting and pressing of the coating onto the surface.

Finally, it is strenuous and difficult to form a surface coating covering the entire surface of the base layer, i.e., both the upper side and lower side of the base layer and its edge surfaces, by use of the prior art method.

The object of the present invention is to provide a method of the type mentioned in the introductory part which is simpler than the prior art method and by which a mineral fibre element having improved properties can be obtained.

SUMMARY OF THE INVENTION

The method according to the invention is characterized in that the surface coating is formed directly on the surface of the base layer and that the surface coating is formed by heating a thermoplastic polymer material so as to melt it and distributing the polymer melt obtained in the form of fibres and/or filaments on the surface of the base layer and cooling it to form a solid layer.

The invention is based on the discovery that, by forming the polymer layer directly on the surface of the mineral fibre material, the adhesive effect possessed by thermoplastic polymer materials in a melted or partly melted state can be utilized to obtain a highly effective adhesion between the mineral fibre layer and the surface coating and at the same time the use of a further binder can be avoided, thereby allowing the thermal value of the mineral fibre element to be reduced.

Furthermore, the invention is based on the discovery that the non-woven material used in the prior art method, in particular as a result of the strength requirements demanded for effecting the application of the material onto a mineral fibre base layer, has properties which are undesired, unnecessary and unexpedient as far as its function as a surface coating is concerned, and that the direct formation of the surface coating on the mineral fibre material provides a possibility of obtaining a surface coating, properties are exclusively determined on the basis of the desired functional considerations.

Thus, the method according to the invention provides a possibility of forming a surface coating with an arbitrary surface weight, and as a result it is possible to obtain a material saving as compared to the prior art method.

Furthermore, by using the present method it is possible to form a surface coating consisting of fibres having a smaller thickness than that of the fibres of the non-woven materials used in the prior art method, and thus a material saving can be obtained as well as a possibility of increasing the number of fibres per area unit and hence the filtration capacity of the surface coating.

Finally, the invention is based on the discovery that a surface coated mineral fibre element can be produced more economically and easily by forming the surface coating directly on the mineral fibre material than by adhering a pre-manufactured non-woven material onto the mineral fibre material, as the former method does not require a separate process equipment for producing a non-woven material, and hence the process steps associated therewith can be avoided, and as the former method only requires one process step, whereas the latter method requires at least two process steps.

In addition, the surface coating formed by the present method is cut more easily than the prior art surface coating, which to a large extent facilitates the cutting of the mineral fibre elements, which ordinarily is necessary in connection with the mounting thereof.

As used in the present invention the term "mineral fibres" includes rock fibres, glass fibres and slag fibres.

As used in the present invention the term "thermoplastic polymer material" means any natural or synthetic thermoplastic polymer or polymer blend. A thermoplastic material is characterized in that it is solid or partially solid at room temperature or at temperature of use, that it melts when heated and that it solidifies or resumes a solid or partially solid form when cooled.

The term "thermoplastic polymer material" also includes such materials which are ordinarily referred to as "thermoplastic hot melt adhesives" or "hot melt adhesives" or simply "hot melts".

By way of examples thermoplastic polymer materials are polymers of ethylenically unsaturated monomers, such as polyethylene, polypropylene, polybutylenes, polystyrenes, poly(α-methyl styrene), polyvinyl chloride, polyvinyl acetate, polymethyl methacrylate, polyethyl acrylate, polyacrylonitrile, etc; copolymers of ethylenically unsaturated monomers, such as copolymers of ethylene and propylene, ethylene and styrene, polyvinyl acetate, styrene and maleic anhydride, styrene and methyl methacrylate, styrene and ethyl acrylate, styrene and acrylonitrile, methyl methacrylate and ethyl acrylate etc; polymers and copolymers of conjugated dienes, such as polybutadiene, polyisoprene and polychloroprene and polymers of bi-polyfunctional monomers, such as polyesters, polycarbonates, polyamides and polyepoxides.

Particularly preferred thermoplastic polymer materials are polyesters, polyamides, polypropylene and polyvinyl acetate.

By using the method according to the invention it is possible, as mentioned above, to produce mineral fibre elements having a surface coating of an arbitrary thickness.

However, in order to obtain a suitable tactility of the finished product, it is preferred that the surface coating have a surface weight of from 2 $g/m^2$ to 50 $g/m^2$, preferably from 5 $g/m^2$ to 20 $g/m^2$ and most preferably from 10 $g/m^2$ to 15 $g/m^2$.

The base layer may have any form and typically it has the form of an endless web, a web, a mat or a sheet.

Mats and sheets may be formed by cutting.

Furthermore, the present invention relates to an apparatus for carrying out the method of the invention, which apparatus is characterized in that it comprises one or more units, each unit comprising means for melting a thermoplastic polymer material, a number of nozzles, means for extruding the polymer melt obtained through the nozzles and distributing the extruded polymer material on the surface of a mineral fibre base layer, and means for directing one or more high pressure gas streams closely past the nozzles in order to elongate the extruded polymer material so as to form thin filaments and/or fibres.

The melting means may have the form of an extruder or a melting chamber which, e.g., can be heated by means of electric heating elements.

A preferred embodiment of the apparatus according to the invention is characterized in that it comprises an oblong dispensing chamber which via a pump is in liquid communication with the melting means and which at its distal end comprises a number of closely spaced nozzles, two chambers located along the two side walls of the dispensing chamber and at the distal end of which a longitudinal slot is formed, and means for directing a high pressure gas stream through the said side wall chambers and out through the slots.

An apparatus of the above mentioned type is ordinarily referred to as a "melt blow apparatus".

Another preferred embodiment of the apparatus according to the invention is characterized in that it optionally comprises means for mixing a gas into the polymer melt and that it comprises a number of pressure guns, each comprising a nozzle, and which via a pump are in liquid communication with the melting means, and means for directing one or more high pressure gas streams past each of the mouths of the pressure guns.

An apparatus of the above mentioned type is ordinarily referred to as a "hot melt spray apparatus".

Optionally, the apparatus according to the invention comprises means for supporting and optionally conveying the base layer.

Such support means may, e.g., have the form of any suitable transport means, such as roller belt, roller path, conveyor belt or conveyor path.

The apparatus according to the invention may be disposed between two such transport means or vis-a-vis an opening formed in such a transport means.

In the apparatus according to the invention the nozzles are preferably equally spaced.

When using the apparatus according to the invention it is preferably located above a mineral fibre base layer conveyed continuously in a distance therefrom.

The apparatus according to the invention is preferably located in such a manner that the nozzles extend over the entire dimension of the base layer in a direction perpendicularly to the direction of advance of the transport means.

The apparatus according to the invention preferably comprises a suction device, such as a suction box, located below the base layer and vis-a-vis the nozzles and which serves to remove the gas used for elongation of the polymer material extruded through the nozzles.

When it is desired to coat both the upper side and the lower side of a base layer conveyed on a transport means, this can be achieved by using two apparatuses according to the invention, the apparatuses being located above and below, respectively, the base layer and displaced in relation to each other and each apparatus having a cooperating suction device located on the opposite side of the base layer.

Alternatively, two apparatus located displaceably in relation to each other on the same side of the base layer can be used, in which case a turning of the base layer between the two apparatuses is effected.

A melt spray apparatus, vide the above definition thereof, is suitable for use without a cooperating suction device.

Thus, in the coating of both the upper side and the lower side of a base layer conveyed on a transport means by use of a melt spray apparatus, the desired coating can be obtained by using two such apparatuses located above and below, respectively, the base layer and vis-a-vis each other or by using such an apparatus in which the nozzles are disposed both above and below the base layer.

A particularly preferred embodiment of the melt spray apparatus defined above is characterized in that one or more units together comprise a number of pressure guns which can be disposed and/or moved in such a manner that the polymer material emitted by the guns can be distributed over the entire surface of the base layer.

The above-mentioned particularly preferred embodiment of the apparatus according to the invention provides a possibility of producing a fully coated mineral fibre element.

In the coating of, e.g., web, mat or sheet formed base layers it is thus possible to coat in a simple manner both the upper side and the lower side of the base layer as well as its edge sides.

The above-mentioned particularly preferred apparatus preferably comprises partly pressure guns disposed circumferentially around the whole of a base layer conveyed on a transport means and which are equally spaced, and by means of which the upper side and the lower side of the base layer as well as its side edge surfaces can be coated, partly one or more pressure guns which are displaceable in vertical direction or in a vertical plane, and by means of which the end edge surfaces of the base layer can be coated.

Such displaceable pressure guns are preferably automatically controllable.

A particularly preferred embodiment of the melt blow apparatus defined above, wherein the apparatus comprises a suction device, is characterized in that it comprises a dispensing chamber having a length greater than the dimension of the base layer in the direction extending parallel with the chamber.

By using the above-mentioned particularly preferred embodiment of the apparatus according to the invention in the coating of, e.g., web, mat or sheet formed base layers, it is possible to coat in a simple manner both the upper side and the lower side of the base layer as well as its side edge surfaces, as the polymer material dispensed outside the width dimension of the base layer can be applied to the side edge surfaces partly by means of the suction device.

The high pressure gas used for elongation of the polymer material extruded from the nozzles is preferably atmospheric air.

The high pressure gas used is preferably hot in order to avoid excessive cooling of the extruded polymer melt before it is deposited on the surface of the base layer.

The gas can be pressurized by means of, e.g., a blower or a compressor.

As mentioned above, the melt spray apparatus according to the invention can optionally comprise means for mixing a gas into the polymer melt so as to form a melt/gas mixture.

When such a melt/gas mixture is dispensed from the above-mentioned melt spray apparatus, the gas will expand in the polymer melt, and as a result a certain foaming of the dispensed polymer material is obtained during the cooling of the melt and the subsequent solidification thereof to form a netting consisting of partially foamed strings.

By using foamed fibres a surface coating can be obtained, which covers a greater portion of the surface of the base layer and hence has an increased tactility and mineral fibre retention capacity compared to a coating consisting of non-foamed fibres and of the same surface weight.

Alternatively, the above-mentioned increased covering capacity can be utilized to form a coating having a lower surface weight and hence to reduce the material consumption.

The gas used for admixture with the polymer melt can be nitrogen or carbon dioxide.

The invention will now be described in further detail with reference to the drawings.

DETAILED DESCRIPTION OF THE INVENTION

Figure 1:
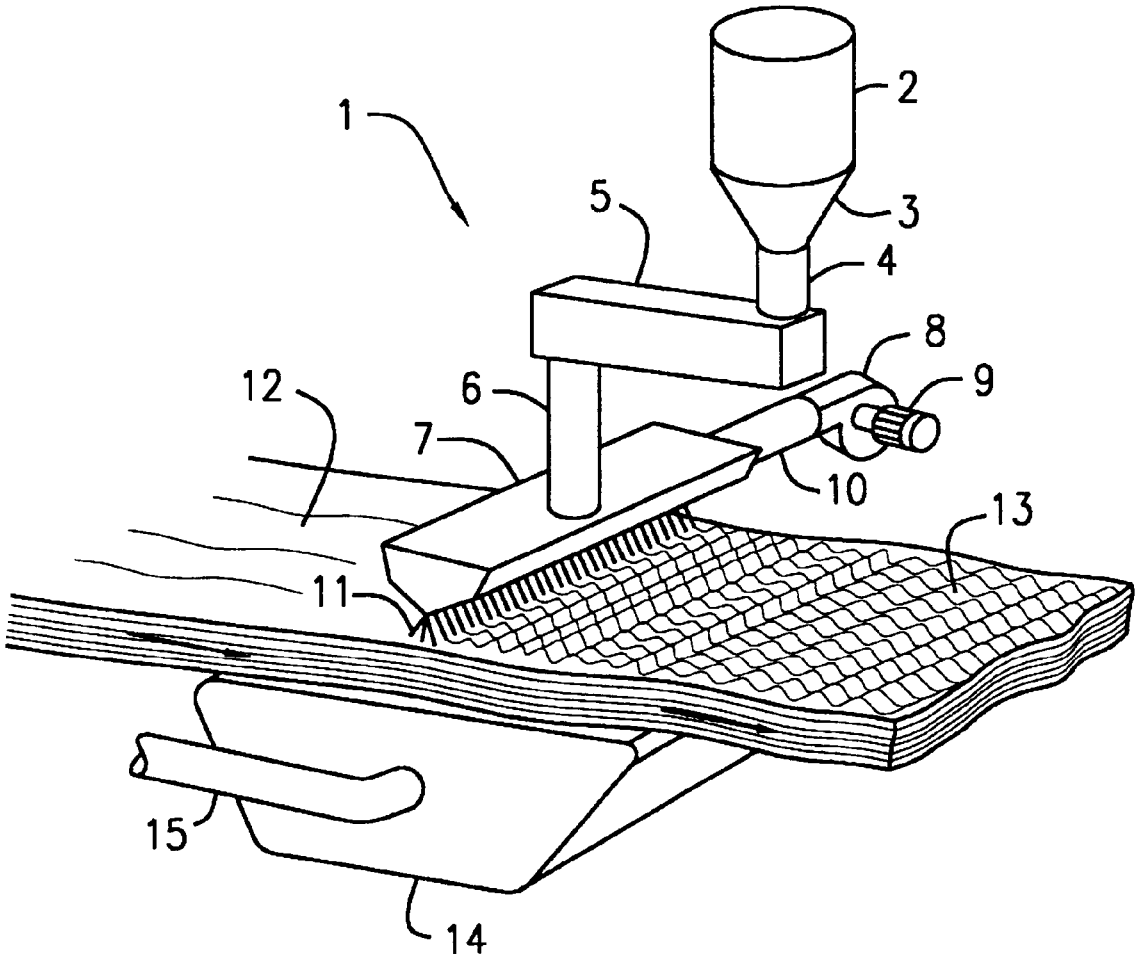
FIG. 1 is a perspective view of a preferred embodiment of the apparatus according to the invention.

FIG. 1 shows an apparatus 1 comprising an open container 2 for filling of a thermoplastic polymer material in a solid form, e.g., in the form of pellets, the lower portion of the container 2 having the form of a hopper 3 debouching into a pipe 4 by means of which the container 2 is connected with an extruder 5 wherein a heating of the polymer material for melting thereof is effected and from which the polymer melt obtained is extruded.

The extrusion of the polymer melt from the extruder 5 is effected by means of a rotatable screw conveyor located in the interior of the extruder 5 and which is driven by a motor (not shown).

The polymer melt extruded from the extruder 5 is conveyed via a pipe 6 and by means of a pump (not shown) to an oblong dispensing container 7 which narrows downwardly, and which in its bottom comprises a number of closely spaced nozzles disposed in a row, through which the polymer melt is extruded under the influence of the pressure generated by the pump.

The two side walls of the dispensing container 7 have the form of double walls for forming two slot-formed chambers along the outside of the dispensing container. A slot extending along the row of nozzles is formed at the lower end of each of the two side wall chambers.

Via a pipe 10 hot air is blown into the two side wall chambers by a blower 8 driven by a motor 9 and further out through the two appertaining slots and hence closely past the nozzles where it serves to elongate the polymer strings extruded through the nozzles and to break up the strings into separate fibres and/or filaments 11.

The dispensing container 7 is located above a mineral fibre web 12 conveyed on a conveyor belt (not shown) transversely to the direction of advance of the web. The dispensing container 7 has a length corresponding to the width of the mineral fibre web 12.

The fibres and/or filaments 11 emitted from the dispensing container are deposited on the surface of the mineral fibre web 12 so as to form a coherent netting 13.

Below the mineral fibre web 12 a suction box 14 is located vis-a-vis the dispensing container 7 and between two conveyor belts (not shown), the suction box removing the air blown out through the slots in the side wall chambers.

The suction box 14 is connected with a suction pump (not shown) via a pipe 15.

Figure 2:
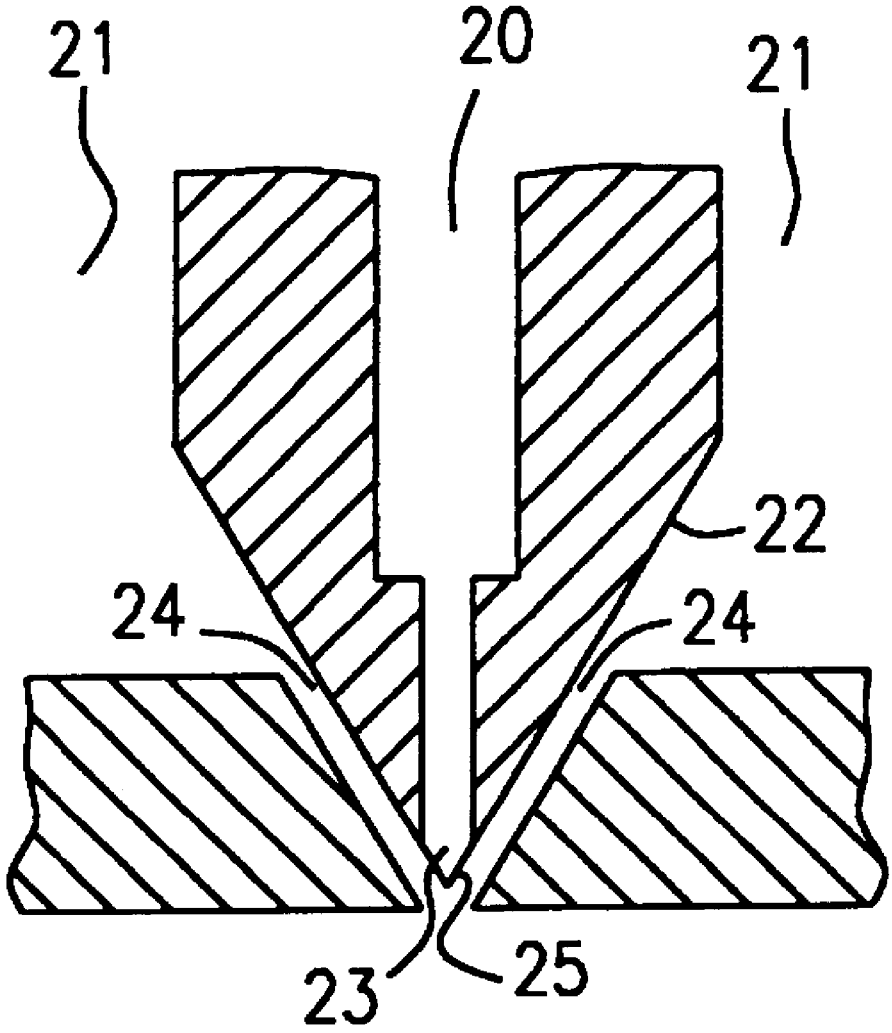
FIG. 2 is a sectional view of the lower portion of the dispensing container of the apparatus of FIG. 1.

FIG. 2 shows a cross section of the lower portion of the dispensing container 7 of the apparatus of FIG. 1. The dispensing container 7 comprises an interior chamber 20 for containing the polymer melt and two side wall chambers 21 for supplying air.

The interior chamber 20 tapers downwardly and in the outermost portion of the tapered section 22 an opening 23 is formed for the dispensing of polymer melt.

In the bottom of each of the two side wall chambers 21 a slot 24 is formed along the outermost portion of the tapered section 22, through which air is blown out from the side wall chambers 21.

The air blown out through the slots 24 is directed to the tip of the interior chamber 20 where it is contacted with the dispensed polymer melt for the elongation and breaking up of the melt.

Figure 3:
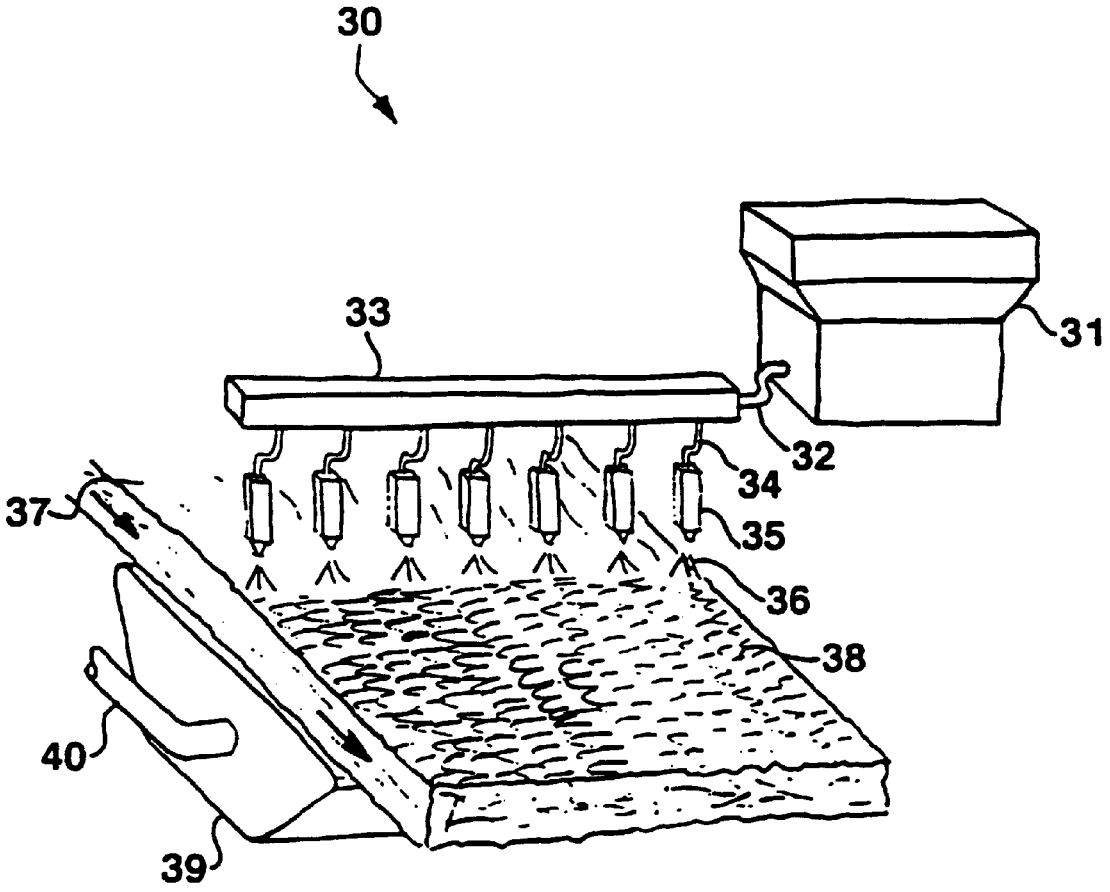
FIG. 3 is a perspective view of another preferred embodiment of the apparatus according to the invention.

FIG. 3 shows an apparatus 30 comprising a polymer melting chamber housing 31 for producing a polymer melt, which housing 31 via a tube 32 is connected with an oblong melt distribution chamber 33 connected via a number of tubes 34 with a number of vertical pressure guns disposed in a row along the melt distribution chamber 33 and which comprise a channel-formed nozzle.

The housing 31 contains a melting chamber wherein a thermoplastic, solid polymer material supplied thereto, e.g., in the form of pellets, is heated by electric heating elements to melt it and from which the polymer melt obtained is subsequently pumped through the tube 32, the distribution chamber 33, the tubes 34 and the pressure guns 35 by a pump located in the housing 31.

Furthermore, the apparatus 30 comprises means (not shown) for supplying air to each pressure gun 35.

The air supplied to the pressure guns 35 is divided in each pressure gun 35 into a number of elongation streams and a number of orientation streams.

The elongation streams serve to elongate the polymer material dispensed from the nozzle and optionally to break it up in individual fibres and/or filaments 36, whereas the orientation streams primarily serve to distribute the fibres and/or filaments 36 obtained in the longitudinal direction of the pressure gun row and optionally also to further elongate and break up the polymer material.

The pressure guns 35 comprise a number of channels for directing the elongation streams, the channels debauching close to the nozzle channel and having a form which impart to the individual partial streams such a direction that the major portion of the formed polymer fibres and/or filaments 36 in a distance from the mouth of the nozzle are distributed in such a manner that the polymer material forms an approximately circular deposit on a horizontal stationary base.

Furthermore, the pressure guns 35 comprise a number of channels for directing the orientation streams, the channels debauching in both a greater axial and a greater radial distance from the mouth of the channel formed nozzle than the orientation streams. The channels have a form which imparts to the partial streams such a direction that the major portion of the polymer fibres and/or filaments 36 are distributed in such a manner that the polymer material forms an oblong approximately oval deposit on a horizontal stationary base.

The row of pressure guns 35 is disposed above a mineral fire web 37 conveyed on a conveyor belt (not shown) transversely to the direction of advance of the web. The pressure guns 35 are equally spaced and extend over the entire width of the mineral fibre web 37.

The fibres and/or filaments 36 dispensed from the pressure guns 35 are deposited on the upper side of the mineral fibre web 37 so as to form a coherent netting 38.

Below the mineral fibre web 37 a suction box 39 is located vis-a-vis the row of pressure guns 35 and between two conveyor belts (not shown), said suction box removing the air blown out from the pressure guns 35.

The suction box is connected with a suction pump (not shown) via a pipe 40.

The invention will now be described in further detail with reference to the following examples.

EXAMPLE 1

In a full scale test plant a series of tests were carried out in which rock fibre webs were coated with fibres of a thermoplastic polymer material by use of the method according to the invention.

The tests were carried out by use of a melt blow apparatus comprising a dispensing chamber located above the rock fibre webs and having a greater length than the width of the rock fibre webs and a suction box located below the webs and vis-a-vis the dispensing chamber. The distance between the nozzles of the dispensing chamber and the upper side of the rock fibre webs was about 0.5 m.

The rock fibre webs contained about 1.6% by weight of a binder in the form of phenol formaldehyde and had a specific weight of about 30 kg/M$^3$ and a thickness of about 100 mm. The webs had a surface temperature of about 20° C.

The polymer starting material used was a polyester in the form of a granulate marketed under the name EMS G760.

The polyester was melted in an extruder and subsequently the melt obtained was extruded through the nozzles in the dispensing chamber and the extruded polymer strings were elongated by means of two gas streams and broken up to form separate fibres which were deposited on the upper surface and the side edge surfaces of the rock fibre webs.

In the tests a surface coating having a surface weight of partly 10 g/m$^2$ and partly 15 g/m$^2$ was formed. The surface coating had the appearance of a non-woven material.

The coated rock fibre webs produced had a tactility corresponding completely to the tactility of the prior art mineral fibre elements having a surface coating consisting of polyester.

The polyester fibres applied had an average diameter of about 5 $\mu$m.

The surface coating having a surface weight of 10 g/m$^2$ had a thermal value of 0.3 MJ/m$^2$, whereas the coating having a surface weight of 15 g/m$^2$ had a thermal value of 0.45 MJ/m$^2$. For comparison it should be noted that a surface coating consisting of a non-woven material of polyester and having a surface weight of 20 g/m$^2$ and an adhesive layer of phenol formaldehyde resin has a thermal value of 1.0 MJ/m$^2$.

Furthermore, the air permeability of the rock fibre webs produced was determined and the results showed that no significant difference in air permeability was observed between the coated webs and corresponding webs with no coating.

Furthermore, in the tests a mineral fibre web comprising a surface coating having a surface weight of 15 g/m$^2$ on both sides of the web was produced.

The tensile strength of this web was determined and as a result it was found that the tensile strength was 25% higher than the tensile strength of a corresponding rock fibre web without any surface coating.

EXAMPLE 2

In a full scale test plant a series of tests were carried out in which rock fibre webs were coated with fibres of a thermoplastic polymer material by use of the method according to the invention.

An initial test series was carried out by use of a melt spray apparatus wherein the pressure guns were located in a row above the rock fibre webs and spaced 10 cm apart, and each individual pressure gun laid out a layer of a width of from 10 cm to 15 cm. The distance between the nozzle mouths of the pressure guns and the upper side of the mineral fibre webs was of from about 0.3 to about 0.5 m.

Air having a pressure of 4–5 bars and a temperature of 210–230° C. was used as elongation and orientation gas.

The rock fibre webs contained about 1.6% by weight of a binder in the form of phenol formaldehyde and had a specific weight of about 30 kg/m$^3$ and a thickness of about 100 mm. The webs had a surface temperature of about 20° C. on the application of the surface coating.

A polyester marketed by the company Hüls under the name Dynapol S 390 was used as polymer material.

The polyester was melted in a melting vessel at a temperature of about 220° C., and subsequently the melt obtained was extruded through the nozzles in the pressure guns, and the extruded polymer strings were elongated by a number of air streams and broken up so as to form separate fibres which were deposited on the surface of the rock fibre webs. All the sides of the webs were coated.

The coating formed had a surface weight of 15 g/m$^2$ and the adhesion between the rock fibre material and the coating was satisfactory as tearing tests showed that the rock fibre material was spread out in separate layers before the surface coating was torn off the rock fibre material. The polyester fibres applied had an average diameter of about 40 $\mu$m. The coating was tactile.

Another test series was carried out by use of a melt spray apparatus comprising means for mixing a gas into the polymer melt. The remaining characteristics of the apparatus were identical with those of the apparatus used in the initial test row, just as the remaining test conditions were identical with those used in the initial test series.

In this test series a synthetic hot melt marketed under the name Henkel Q2279 was used as a polymer material.

The polymer was melted in a melting vessel at a temperature of about 160° C., and subsequently a foaming gas in the form of nitrogen was admixed with the melt and the mixture of melt and gas obtained was then extruded through the nozzles in the pressure guns.

The extruded melt/gas mixture was then elongated by a number of air streams and broken up so as to form separate fibres which were deposited on the surface of the rock fibre webs. All the sides of the webs were coated.

The surface coating formed had a surface weight of 15 g/m$^2$, and the adhesion between the rock fibre material and the coating was satisfactory, as tearing tests showed that the rock fibre material was broken up in separate layers before the surface coating was torn off the rock fibre material.

The polymer fibres applied had an average diameter of about 80 $\mu$m, and the netting formed covered a greater portion of the surface of the rock fibre material than the netting formed in the initial test series, but the netting consisting of foamed fibres was still permeable to air, however.

The coating formed in the second test series had an increased tactility and rock fibre retention capacity as compared to the coating formed in the initial test series.

What is claimed is:

1. A method of providing a fibrous thermoplastic netting layer adhered around all surfaces of a mineral fibre base layer and thereby producing a mineral fibre element for use as insulation, said method comprising the steps of (a) providing the mineral fibre base layer consisting essentially of mineral fibres wherein the layer has surfaces consisting of an upper side, a lower side and side edges, (b) providing a melt of thermoplastic polymeric material, (c) discharging the melt of thermoplastic material through nozzles towards said surfaces of the mineral fibre base layer, (d) collecting and cooling the thermoplastic material on each of said surfaces in the form of filaments or fibres or both and thereby forming the fibrous netting layer adhering to each of surfaces of the mineral fibre base layer, wherein the weight of the fibrous netting layer is from 2 to 50 g/m$^2$ and the adherence of the netting to the mineral fibre base layer consists essentially only of the adhesion of thermoplastic of the netting layer to the mineral fibres of the mineral fibre base layer.

2. A method according to claim 1 in which the weight of the fibrous netting layer is 2 to 20 g/m$^2$.

3. A method according to claim 1 in which the weight of the fibrous netting layer is 2 to 15 g/m$^2$.

4. A method according to claim 3 in which the melt is extrided through the said nozzles towards said surfaces and extruded melt is elongated by high pressure gas streams which are directed close to the nozzles.

5. A method according to claim 3 in which the melt is mixed with gas and discharged from the nozzles as a spray.

6. A method according to claim 5 in which the mineral fibre base layer is an endless web.

7. A method according to claim 5 comprising the preliminary step of forming the mineral fibre base layer by cutting an endless web into mats.

8. A method according to claim 1 in which the melt is extruded through the said nozzles towards said surfaces and extruded melt is elongated by high pressure gas streams which are directed close to the nozzles.

9. A method according to claim 1 in which the melt is mixed with gas and discharged from the nozzles as a spray.

10. A method according to claim 1 in which the mineral fibre base layer is an endless web.

11. A method according to claim 1 comprising the preliminary step of forming the mineral fibre base layer by cutting an endless web into mats.

12. A method of providing fibrous thermoplastic netting layer adhered to a surface of a mineral fibre base layer and thereby producing a mineral fibre element for use as insulation, said method comprising the steps of (a) providing the mineral fibre base layer consisting essentially of mineral fibres wherein the layer has surfaces consisting of an upper side, a lower side and side edges, (b) providing a melt of thermoplastic polymeric materials, (c) discharging the melt of thermoplastic material through nozzles towards at least the upper side surface of the mineral fibre base layer, (d) collecting and cooling the thermoplastic material on said surface in the form of filaments or fibres or both and thereby forming the fibrous netting layer adhering to said surface of the mineral fibre base layer, wherein the weight of the fibrous netting layer is 2 to 50 g/m$^2$ and the adherence of the netting to the mineral fibre base layer consists essentially only of the adhesion of thermoplastic of the netting layer to the mineral fibres of the mineral fibre base layer, and wherein either (a) the melt is extruded through the said nozzles towards the said surfaces and extruded melt is elongated by high pressure gas streams which are directed close to the nozzles or (b) the melt is mixed with gas and discharged from the nozzles as a spray to form a netting of partially foamed strings.

13. A method according to claim 12 in which the mineral fibre base layer is an endless web.

14. A method according to claim 12 comprising the preliminary step of forming the mineral fibre base layer by cutting an endless web into mats.

15. A method according to claim 12 in which the weight of the fibrous netting layer is 2 to 20 g/m$^2$.

16. A method according to claim 12 in which the weight of the fibrous netting layer is 2 to 15 g/m$^2$.

* * * * *